US012520914B2

(12) United States Patent
Kozak

(10) Patent No.: US 12,520,914 B2
(45) Date of Patent: Jan. 13, 2026

(54) WATCH WITH RATCHETING STRAP

(71) Applicant: KORE Essentials Inc., Santee, CA (US)

(72) Inventor: Karl Kozak, San Diego, CA (US)

(73) Assignee: KORE Essentials Inc., Santee, CA (US)

( * ) Notice: Subject to any disclaimer, the term of this patent is extended or adjusted under 35 U.S.C. 154(b) by 0 days.

(21) Appl. No.: 18/520,431

(22) Filed: Nov. 27, 2023

(65) Prior Publication Data

US 2024/0130483 A1 Apr. 25, 2024

Related U.S. Application Data

(63) Continuation of application No. 17/399,521, filed on Aug. 11, 2021, now Pat. No. 11,864,638.

(60) Provisional application No. 63/067,143, filed on Aug. 18, 2020.

(51) Int. Cl.
*A44C 5/20* (2006.01)
*A44C 5/14* (2006.01)

(52) U.S. Cl.
CPC ..... *A44C 5/2042* (2013.01); *A44C 5/14* (2013.01)

(58) Field of Classification Search
CPC ..... Y10T 24/2183; Y10T 24/216; Y10T 24/24216; A43C 11/1413; A43C 11/146; A44C 5/2042; A44C 5/14; A44C 5/2071; A44C 5/20; A44C 5/2017; A44B 11/12
USPC ..... 24/DIG. 43, DIG. 47, DIG. 48
See application file for complete search history.

(56) References Cited

U.S. PATENT DOCUMENTS

| | | | | |
|---|---|---|---|---|
| 4,296,532 | A * | 10/1981 | Ho | A44C 5/2071 24/627 |
| 6,561,398 | B1 * | 5/2003 | Cole | B60R 9/048 224/924 |
| 6,715,449 | B1 * | 4/2004 | Jordan | A01K 27/005 24/DIG. 48 |
| 10,130,131 | B2 * | 11/2018 | Ryou | A41F 1/008 |
| 10,299,545 | B2 * | 5/2019 | Rowland | A44B 11/24 |
| 10,576,903 | B2 * | 3/2020 | Rodriguez | B60R 9/10 |
| 10,667,582 | B2 * | 6/2020 | Hestvik | A44B 11/12 |
| 10,842,232 | B1 * | 11/2020 | Kelly | A44B 11/125 |
| 11,540,597 | B1 * | 1/2023 | Rowland | A44B 11/20 |
| 12,082,657 | B2 * | 9/2024 | Rowland | A44B 11/12 |

(Continued)

FOREIGN PATENT DOCUMENTS

EP 0373806 A2 * 12/1989

*Primary Examiner* — Jack W Lavinder
*Assistant Examiner* — Louis A Mercado
(74) *Attorney, Agent, or Firm* — CP LAW GROUP PC; Cy Bates

(57) ABSTRACT

A watchstrap is provided with a novel ratcheting buckle and strap, whereby the user may incrementally adjust fitment of a corresponding watch via a ratcheting mechanism embodied between the ratcheting buckle and strap. The strap includes a first strap portion and a second strap portion. The first strap portion has a linear rack and a plurality of teeth embedded in the linear rack. The second strap portion is coupled to a buckle wherein the buckle is configured to slideably engage with one or more of the plurality of teeth as the first strap portion is inserted through the buckle and translated therethrough. Terminal ends of both the first strap portion and the second strap portion are each configured to couple to the corresponding watch.

7 Claims, 10 Drawing Sheets

(56) References Cited

U.S. PATENT DOCUMENTS

| | | | | |
|---|---|---|---|---|
| 2013/0167288 | A1* | 7/2013 | Rowland | A41F 9/002 2/338 |
| 2017/0314590 | A1* | 11/2017 | Hunsucker | A41F 9/002 |

* cited by examiner

WATCH WITH RATCHETING STRAP

CROSS-REFERENCE TO RELATED APPLICATIONS

This application claims benefit of priority with U.S. Provisional Application Ser. No. 63/067,143, filed Aug. 18, 2020; the entire contents of which are hereby incorporated by reference

BACKGROUND

Field of the Invention

The invention relates to an article of manufacture, namely a wristwatch, wherein the wristwatch is adapted with an adjustable ratcheting band.

Description of the Related Art

A watch is a portable timepiece intended to be carried or worn by a person. It is designed to keep a consistent movement despite the motions caused by the person's activities. A wristwatch is designed to be worn around the wrist, attached by a watch strap or other type of bracelet, including metal bands, leather straps or any other kind of bracelet.

Watches progressed in the 17th century from spring-powered clocks, which appeared as early as the 14th century. During most of its history the watch was a mechanical device, driven by clockwork, powered by winding a mainspring, and keeping time with an oscillating balance wheel. These are called mechanical watches. In the 1960s the electronic quartz watch was invented, which was powered by a battery and kept time with a vibrating quartz crystal. By the 1980s the quartz watch had taken over most of the market from the mechanical watch. Historically, this is called the quartz revolution. Developments in the 2010s include smartwatches, which are elaborate computer-like electronic devices designed to be worn on a wrist. They generally incorporate timekeeping functions, but these are only a small subset of the smartwatch's facilities.

In general, modern watches often display the day, date, month, and year. For mechanical watches, various extra features called "complications", such as moon-phase displays and the different types of tourbillon, are sometimes included. Most electronic quartz watches, on the other hand, include time-related features such as timers, chronographs and alarm functions. Furthermore, some modern smartwatches even incorporate calculators, GPS and Bluetooth technology or have heart-rate monitoring capabilities, and some of them use radio clock technology to regularly correct the time.

While several improvements have addressed functionality of the time-keeping portion of the wristwatch, there has been little innovation concerning the watch band, in particular issues of fitment, such as, without limitation, limited discrete fitment settings and ease of adjustment.

SUMMARY

A wristwatch is provided incorporating one of a plurality of possible case embodiments, such as, without limitation, mechanical and electronic movements, and a novel ratcheting buckle and corresponding strap, whereby the user may incrementally adjust fitment of the watch via a ratcheting mechanism embodied between the ratcheting buckle and strap.

BRIEF DESCRIPTION OF THE DRAWINGS

The invention is further described in accordance with multiple embodiments and with reference to the drawings, wherein.

DETAILED DESCRIPTION OF EMBODIMENTS

Figure 1:
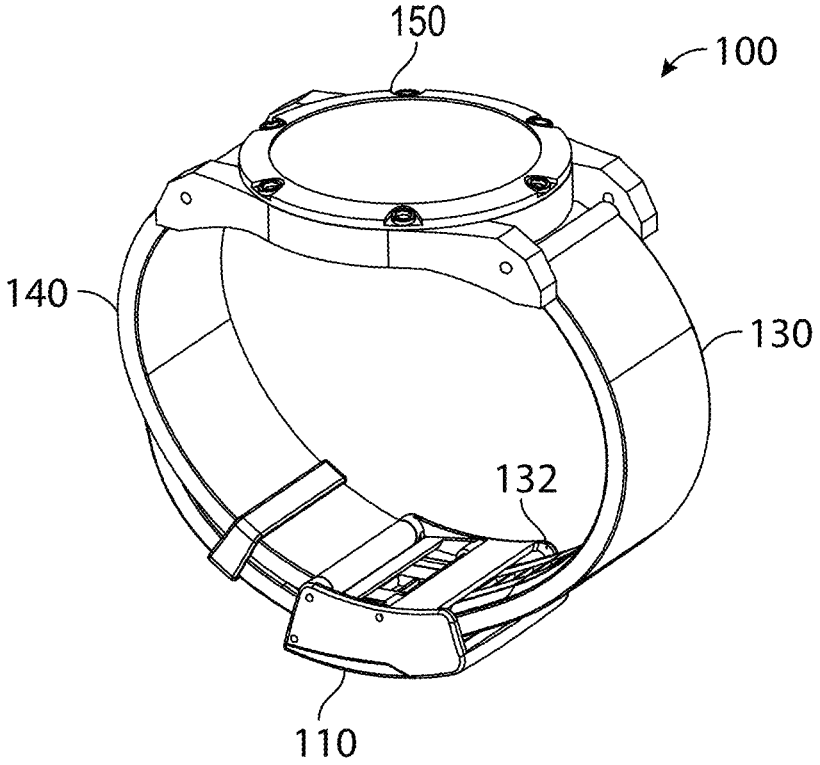
FIG. 1 shows a perspective view of a watch with ratcheting strap in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain illustrated embodiments. However, a myriad of other embodiments which will not be expressly described herein would be readily understood by one having skill in the art upon a thorough review hereof. For example, certain features may be taken individually and combined with other features, either expressly described herein or otherwise known in the art, to practice other embodiments that may be outside the explicit descriptions herein, but that may be otherwise within the spirit and scope of the invention. Accordingly, any reviewer of the instant disclosure should interpret the scope of the invention by the claims, and such scope shall not be limited by the embodiments described and illustrated herein.

GENERAL EMBODIMENTS

In one embodiment, a watch with a ratcheting strap is disclosed. The watch with ratcheting strap comprises a buckle which comprises a base, a linkage element, and a cam lever. The base is coupled to the linkage element via a combination of a first pin, and a spring. The linkage element comprises a pawl, a loading-brace, and a fulcrum wherein the fulcrum is disposed between the pawl and the loading-brace. The cam-lever comprises a cam portion and a lever portion, wherein the cam-lever is coupled to the linkage element via a second pin. The watch with ratcheting strap further comprises a strap including a first strap portion and a second strap portion, the first strap portion comprising a linear rack and a plurality of teeth embedded in the linear rack. The second strap portion is coupled to the buckle. A case assembly is coupled to each of the first and second strap portions. With the cam-lever in a collapsed configuration, the cam-lever is configured to engage the linkage-element at the loading-brace thereof for articulating the linkage-element and engaging the pawl at the teeth of the linear rack, wherein the first strap portion is slideably translatable through the buckle only in a first direction corresponding to tightening the strap with the cam-lever in the collapsed configuration. Additionally, with the cam-lever in an open configuration, the cam-lever is configured to engage the linkage element at the loading-brace thereof for lifting the loading-brace and dis-engaging the pawl from the teeth of the linear rack, wherein the first strap portion is slideably translatable through the buckle in each of the first direction and a second direction opposite the first direction with the cam-lever in the open configuration.

In some embodiments, the linear rack may comprise a monolithic fabricated piece. The linear rack may be disposed between each of a first and second layer of the first strap portion. The first strap portion may optionally comprise a stitch-line disposed around the plurality of teeth, wherein the stitch-line is configured to couple the first and second layers.

In another embodiment, a watch with ratcheting strap is disclosed. The watch with ratcheting strap comprises a strap including a first strap portion and a second strap portion. The first strap portion comprises a linear rack and a plurality of teeth embedded in the linear rack, and the second strap portion is coupled to a buckle. The buckle comprises a pawl configured to slideably engage up to each of the plurality of teeth of the linear rack as the first strap portion is inserted through a buckle aperture and translated therethrough.

In some embodiments, the watch may further comprise a case assembly coupled to each of the first and second strap portions.

In some embodiments, the linear rack may comprise a monolithic fabricated piece. The linear rack may be disposed between each of a first and second layer of the first strap portion. The first strap portion may further comprise a stitch-line disposed around the plurality of teeth, wherein the stitch-line is configured to couple the first and second layers.

Generally, the buckle comprises a base, a linkage element, and a cam-lever. The base is coupled to the linkage element via a combination of a first pin, and a spring. The linkage element comprises the pawl, a loading-brace, and a fulcrum where the fulcrum may be disposed between the pawl and the loading-brace. The cam-lever comprises a cam portion and a lever portion, wherein the cam-lever is coupled to the linkage via a second pin.

In some embodiments, the linkage element may further comprise a linkage element aperture disposed between the pawl and the loading-brace, wherein the linkage element aperture is configured to receive the first strap portion.

In some embodiments, the cam-lever may be configurable in a collapsed configuration, wherein the cam-lever is configured to engage the linkage element at a loading-brace thereof for articulating the linkage element and engaging the pawl at the teeth of the linear rack, wherein the first strap portion is slideably translatable through the buckle only in a first direction corresponding to tightening the strap with the cam-lever in the collapsed configuration.

In some embodiments, the cam-lever may be configurable in an open configuration, wherein the cam-lever is configured to engage the linkage element at a loading-brace thereof for lifting the loading-brace and dis-engaging the pawl from the teeth of the linear rack, wherein the first strap portion is slideably translatable through the buckle in each of the first direction and a second direction opposite the first direction with the cam-lever in the open configuration.

In some embodiments, the linkage element may comprise a side portion having a zeta-shaped configuration.

In some embodiments, the buckle may comprise a base and a linkage element. The base is coupled to the linkage element via a combination of a first pin, and a spring. The linkage element may comprise a pawl, a lever, and a fulcrum, the fulcrum being disposed between the pawl and the lever. In some embodiments, wherein upon translation of the lever, the linkage element may be configured to about the fulcrum, and the pawl is released from engagement with the plurality of teeth of the linear rack such that the first strap portion becomes releasable from the buckle.

In another embodiment, a watch with ratcheting strap is disclosed. The watch with ratcheting strap comprises a buckle and a strap including a first strap portion and a second strap portion and a case assembly coupled to each of the first and second strap portions. The buckle comprises a base and a linkage element. The base is coupled to the linkage element via a combination of a first pin, and a spring, and the linkage element comprises a pawl, a lever, and a fulcrum, where the fulcrum is disposed between the pawl and the lever. The first strap portion comprises a linear rack and a plurality of teeth embedded in the linear rack. The second strap portion coupled to the buckle. Upon translation of the lever, the linkage element is configured to rotate about the fulcrum, and the pawl is released from engagement with the plurality of teeth of the linear rack such that the first strap portion becomes releasable from the buckle.

In some embodiments, the linear rack may comprise a monolithic fabricated piece. The linear rack may be disposed between each of a first and second layer of the first strap portion. The first strap portion may further comprise a stitch-line disposed around the plurality of teeth, wherein the stitch-line is configured to couple the first and second layers.

First Illustrated Embodiment

Now turning to the drawings wherein the first illustrated embodiment is presented, FIG. 1 shows a perspective view of a watch with ratcheting strap (100) in accordance with a first illustrated embodiment. The watch with ratcheting strap comprises a first strap portion (130), a second strap portion (140) and a case assembly (150) coupled therebetween. The ratcheting strap is shown with a linear rack (132) comprising teeth engaged with a buckle (110). The case assembly may comprise a mechanical, electric, or any watch case that would be appreciated by one with skill in the art, including a smart watch case assembly and the like.

Figure 2:
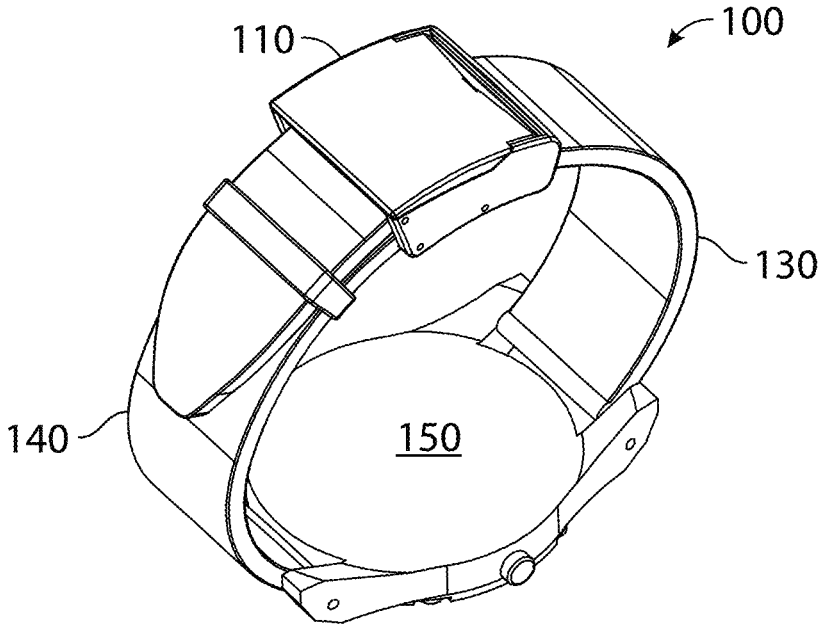
FIG. 2 shows the watch with ratcheting strap from an alternative perspective view according to the first illustrated embodiment.

FIG. 2 shows the watch with ratcheting strap from an alternative perspective view. Here, an underside of the case assembly (150) and the outside of the buckle (110) are visible.

FIGS. 3-6 illustrate the buckle of the watch with a ratcheting strap according to various configurations.

Figure 3:
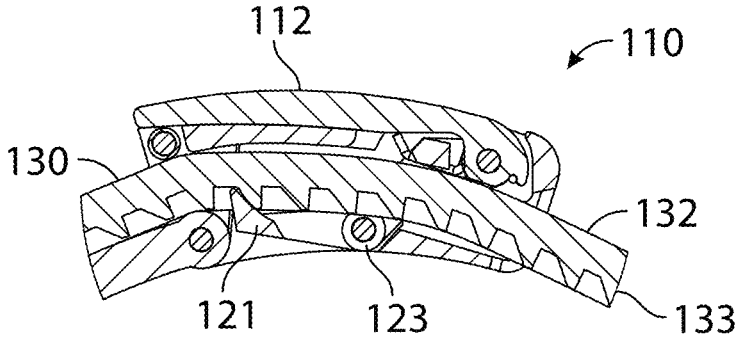
FIG. 3 shows a cross-section view of a ratcheting buckle being closed with a pawl engaged and lateral movement restricted according to the first illustrated embodiment.

FIG. 3 shows a cross-section view of a ratcheting buckle (110) being closed with a pawl (121) engaged and lateral movement restricted according to the first illustrated embodiment. The ratcheting buckle and mechanism is engaged to one tooth from a plurality of teeth (133) arranged along a linear rack (132) wherein the linear rack is disposed on a first strap portion (130). The buckle is shown being closed (in a "collapsed state") with the pawl engaged and lateral movement restricted (i.e. the strap passes in one direction only) form a fulcrum (123). While the pawl of the buckle is shown engaging a single tooth, it would be appreciated by one having skill in the art that multiple teeth can be similarly engaged by changing the shape and/or configuration of the pawl or of the teeth. It will be further appreciated that each of the pawl and corresponding teeth has a sloped surface for enabling the passing of teeth in one direction (i.e. tightening), whereas the teeth each have a counterfacing non-sloped surface for engaging the pawl and stopping translation in the counter-direction (i.e. loosening). In this regard, the pawl and the teeth, in combination with other elements of the buckle, form a "ratcheting strap".

Figure 4:
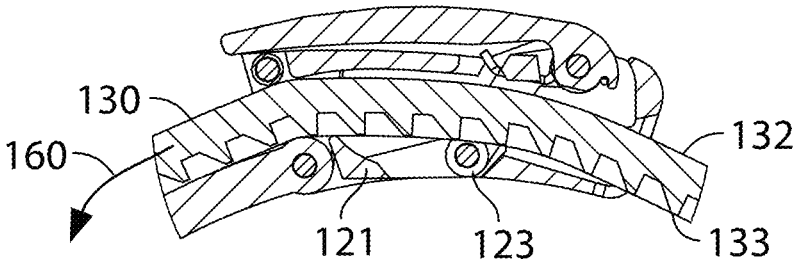
FIG. 4 shows a cross-section view of the ratcheting buckle and with the pawl disengaged and lateral movement allowed in one direction for tightening the strap according to the first illustrated embodiment.

FIG. 4 shows a cross-section view of the ratcheting buckle (110) and with the pawl (121) disengaged and lateral movement allowed in a first direction (160) for tightening the strap according to the first illustrated embodiment. However, the linear rack (132) is restricted from movement in the opposite (loosening) direction. It should be recognized that the linear rack and associated first strap portion (130) may translate in the first direction in each of the closed and semi-closed states. This is achieved by pulling the first strap portion through the buckle, and the sloped surfaces of the teeth (133) and the pawl acting to click through each tooth as the first strap portion is passed in the first direction for tightening.

Figure 5:
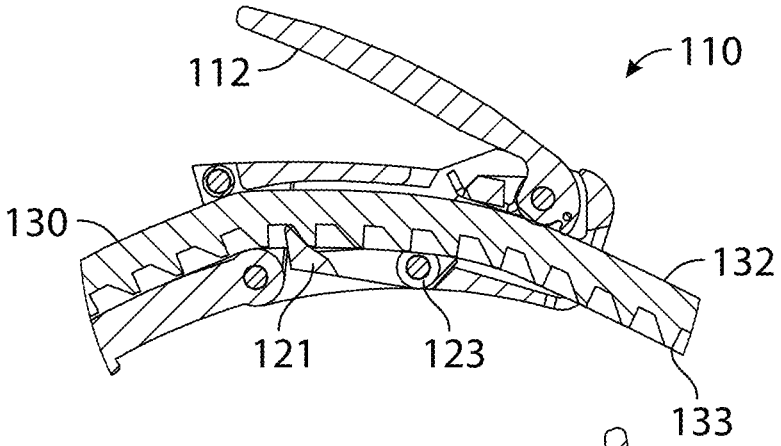
FIG. 5 shows a cross-section view of the ratcheting buckle with the buckle being slightly open with spring bias applied at the pawl to maintain restricted movement to a unilateral direction for tightening according to the first illustrated embodiment.

FIG. 5 shows a cross-section view of the ratcheting buckle (110) with the buckle being slightly open with spring bias applied at the pawl (121) to maintain restricted movement to a unilateral direction for tightening according to the first illustrated embodiment. At this state of opening, the ratcheting mechanism (i.e. the pawl and teeth) continue to restrict slideable translation of the first strap portion (130) through the buckle.

Figure 6:
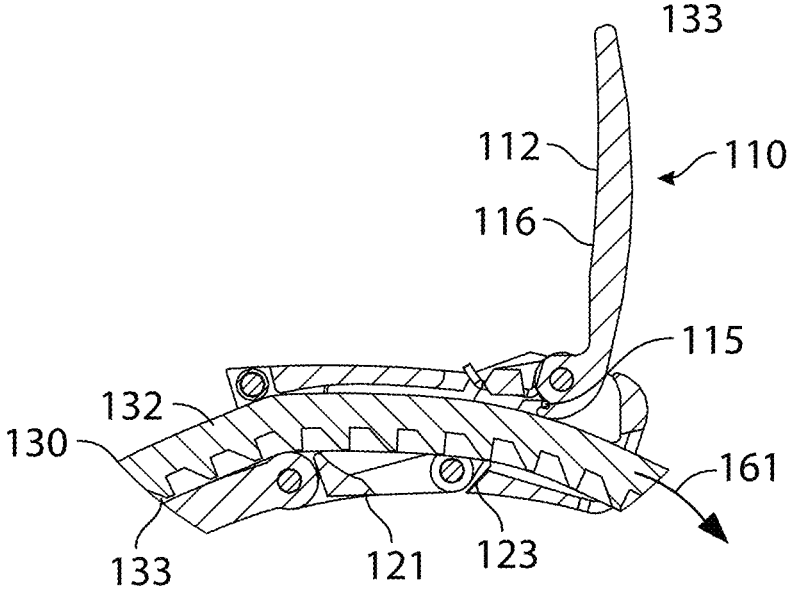
FIG. 6 shows a cross-section view of the ratcheting buckle with a lever fully extended to engage a cam and linkage element according to the first illustrated embodiment.

FIG. 6 shows a cross-section view of the ratcheting buckle (110) with a lever portion (116) fully extended to engage a cam portion (115) and linkage element (120, FIG. 7) according to the first illustrated embodiment. The pawl (121) is disengaged from one or more of the plurality of teeth (133) of the linear rack (132) by pivoting about a fulcrum (123). The strap may translate in either a first direction (160, FIG. 4) or second direction (161). This is generally how one will remove the watch from their wrist. Once the buckle is again closed, the first strap portion (130) may be inserted through a buckle aperture (118, FIG. 7) and pulled to tighten as the pawl clicks past one or more teeth of the linear rack.

Figure 7:
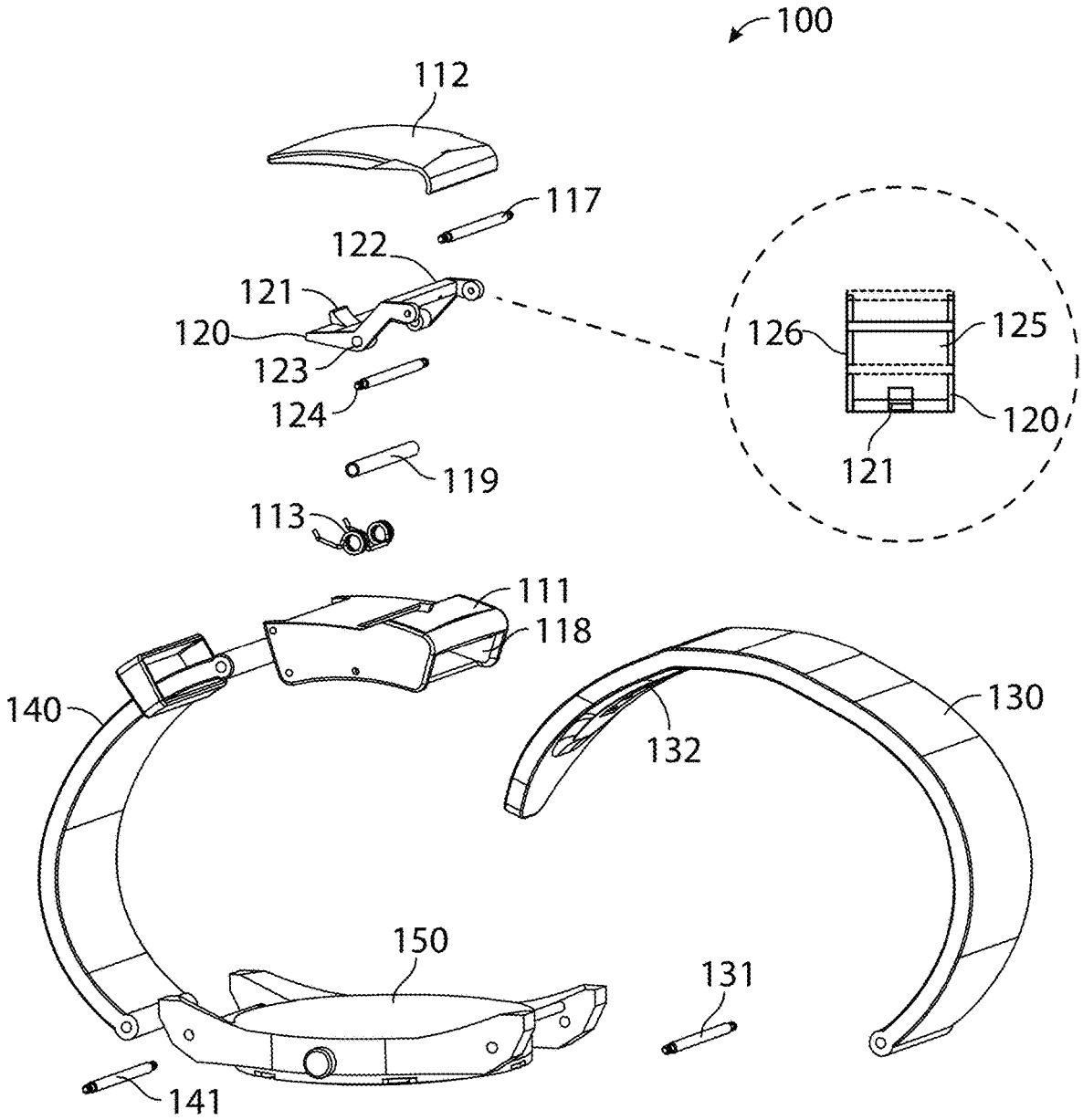
FIG. 7 shows an exploded view the watch with ratcheting strap according to the first illustrated embodiment.

FIG. 7 shows an exploded view the watch with ratcheting strap (100) according to the first illustrated embodiment. Various components are illustrated in relation to one another. From this view, one with skill in the art can appreciate the inner workings of the watch with ratcheting strap according to a preferred embodiment. Here, the case assembly (150) is coupled to each of a first strap portion (130) and a second strap portion (140), generally via pins (131; 141). The first strap portion comprises a linear rack (132) on an underside thereof. The second strap portion comprises a buckle disposed at a terminal end thereof. The buckle comprises a base (111), a linkage element (120) coupled to the base generally via a first pin (124)(or fulcrum pin), a spacer (119), and a spring (113). The spring provides bias to the linkage element for biasing force and a pawl (121) of the linkage element in a direction for engaging teeth of the linear rack with the first strap portion inserted through a buckle aperture (118) In addition, the buckle comprises a cam-lever (112) coupled to the linkage element via second pin (117) (or cam-lever pin). The cam-lever is configured to abut and engage a loading-brace (122) of the linkage element in two distinct fashions: (i) by pressing downwardly (relative to FIG. 7) and pushing the loading-brace to enter the buckle in a closed state (collapsed state), and (ii) by lifting the loading-brace and dis-engaging the pawl from the teeth of the linear rack to enter the buckle in the open state. Here, the linkage element is rocked between the open and collapsed states at a fulcrum (123), for example, where the linkage element is coupled to the base. To achieve levered articulation, the linkage element is fabricated having a zeta-shape configuration at a side portion (126) (or zig-zag shape) as shown. A top view of the linkage element, and a linkage element aperture (125) through which the first strap portion is configured to pass, is further provided in FIG. 7 as bound between the broken lines.

Figure 8:
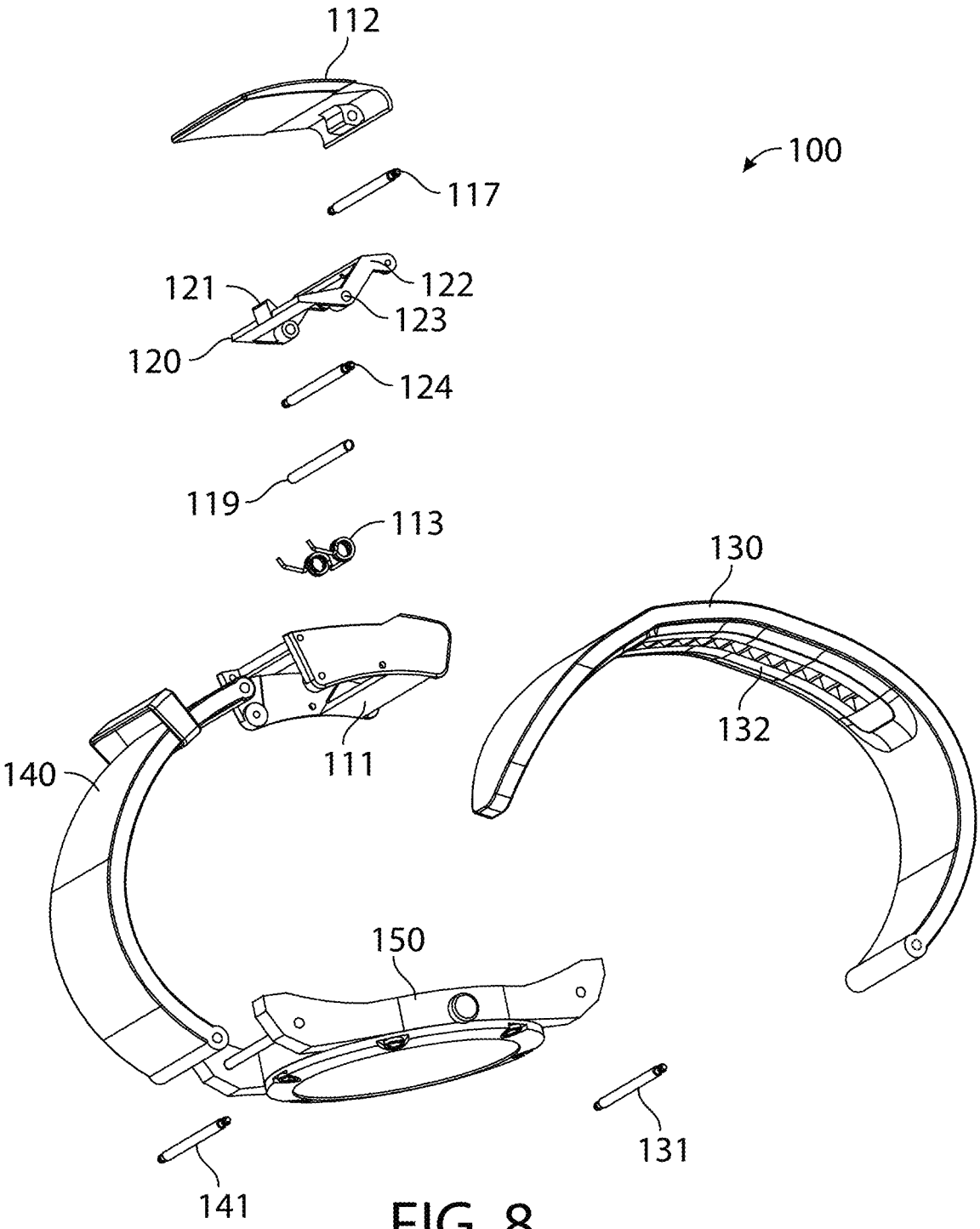
FIG. 8 shows an exploded view of the watch with ratcheting strap from an alternative perspective according to the first illustrated embodiment.

FIG. 8 shows an exploded view of the watch with ratcheting strap (100) from an alternative perspective according to the first illustrated embodiment In this view, elements from FIG. 7 can be appreciated from the alternative perspective.

Figure 9:
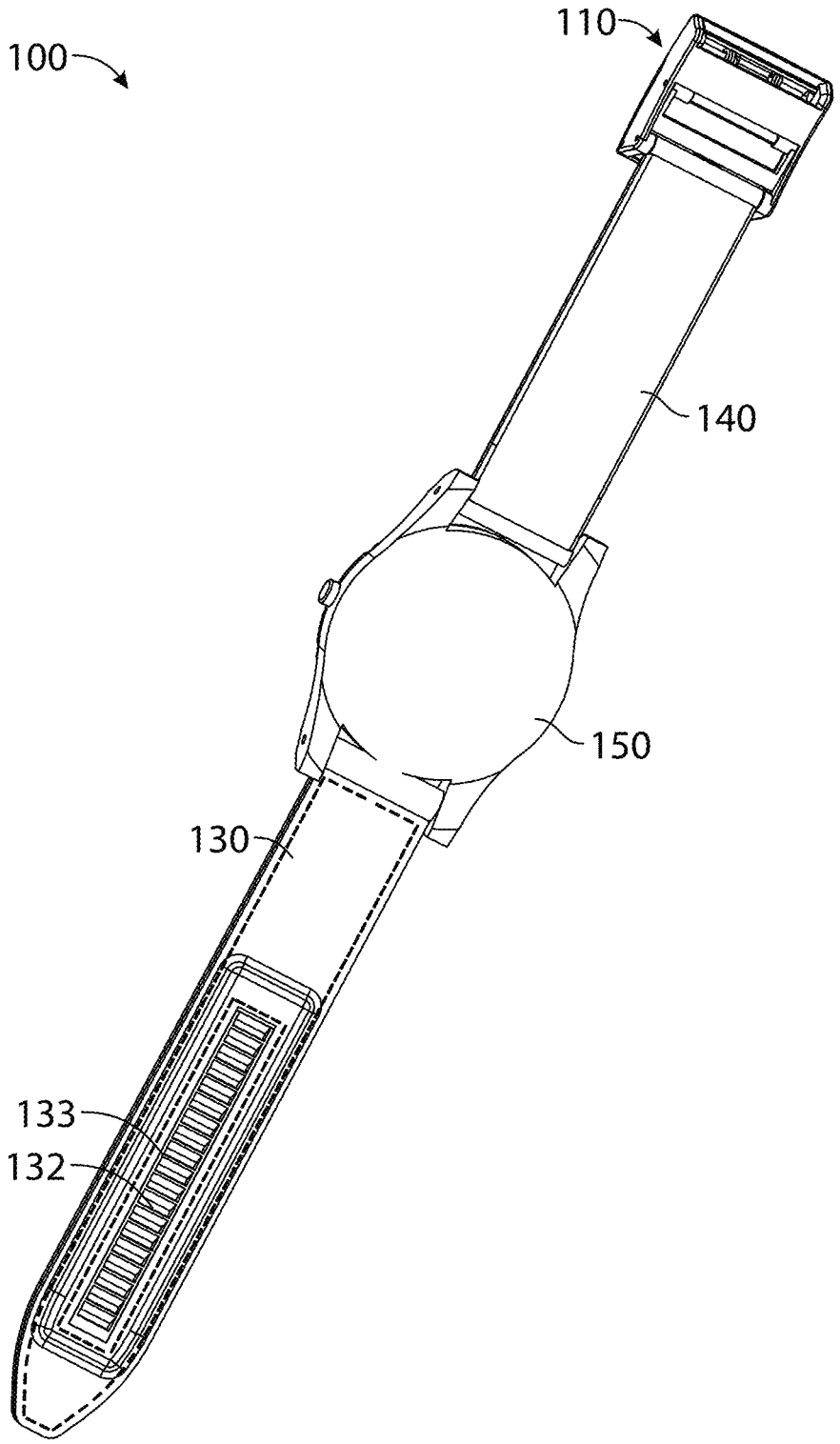
FIG. 9 shows a bottom view of an underside of the watch with ratcheting strap according to the first illustrated embodiment.

FIG. 9 shows a bottom view of an underside of the watch with ratcheting strap (100) according to the first illustrated embodiment. Here, the key features of the watch are shown, including a case assembly (150), a first and second strap portions (130; 140), and a linear rack (132) with a plurality of teeth (133) and a corresponding buckle (110) within which the linear rack is configured to engage via a pawl previously described above.

Figure 10A:
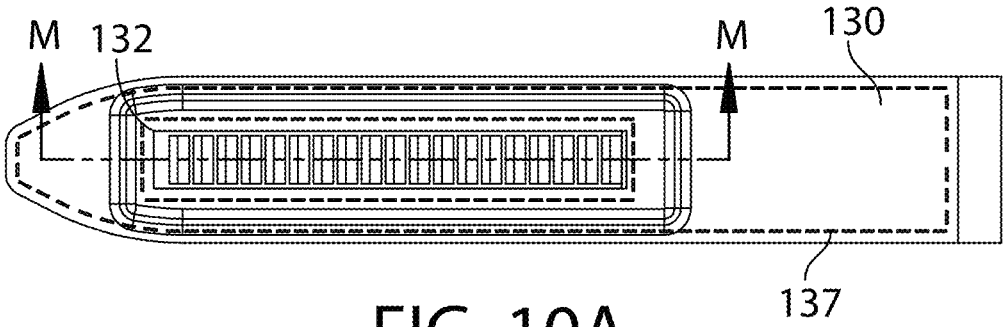
FIG. 10A shows a top view a first strap portion of the watch with ratcheting strap have a linear rack according to the first illustrated embodiment.
Figure 10B:
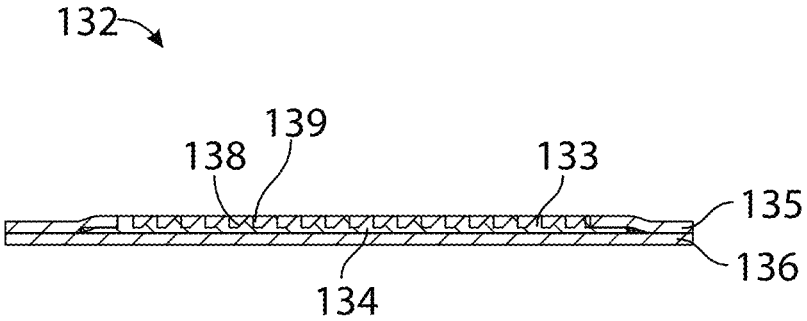
FIG. 10B shows a side-profile of Section M-M of FIG. 10A.
Figure 11A:
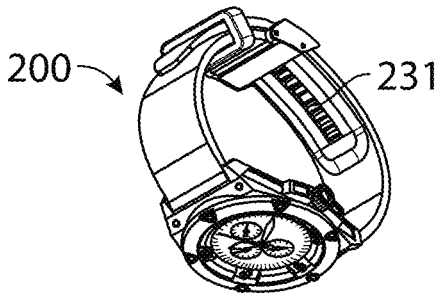
FIGS. 11(A-G) show a watch with ratcheting strap in accordance with a second illustrated embodiment.
Figure 11B:
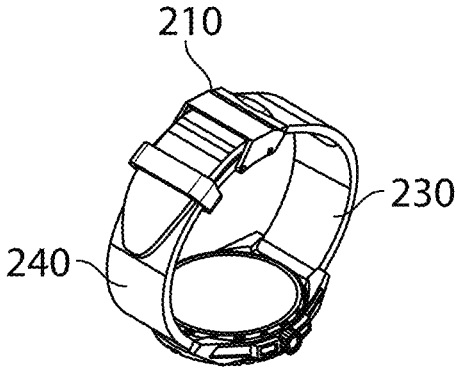
Figure 11C:
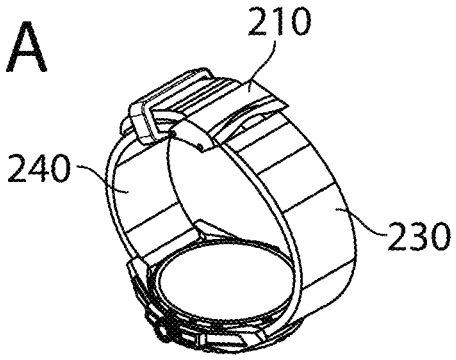
Figure 11D:
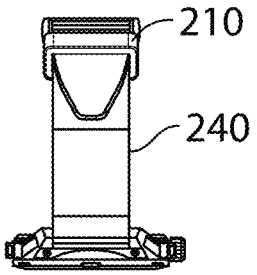
Figure 11E:
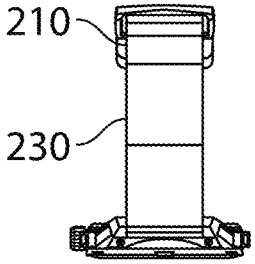
Figure 11F:
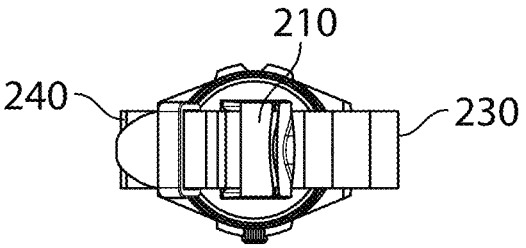
Figure 11G:
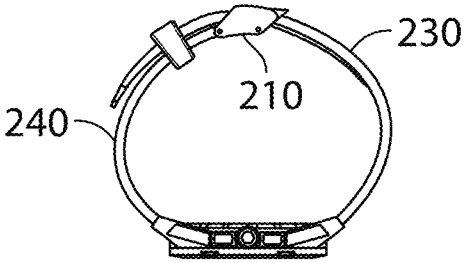

FIG. 10A shows a top view a first strap portion (130) of the watch with ratcheting strap have a linear rack (132) according to the first illustrated embodiment. The first strap portion further includes an optional stitch line (137). FIG. 10B shows a side-profile of Section M-M of FIG. 10A. The linear rack comprises a first layer (135), a second layer (136), and a fabricated monolith piece (134) disposed therebetween. The first and second layers of the strap can be glued with an adhesive or bonding agent, and/or stitched together. The stitching from the stitch line provides an added aesthetic enhancement that is especially preferred to be embodied in high-end watches. A plurality of teeth (133) of the linear rack are further appreciated in FIG. 10B, each including a passing surface (138) and an engaging surface (139).

Second Illustrated Embodiment

The watch with ratcheting strap is now described in accordance with a second illustrated embodiment.

FIGS. 11(A-G) show a watch with ratcheting strap (200) in accordance with a second illustrated embodiment comprising a buckle (210), a first strap portion (230) and second strap portion (240). The first strap portion comprises a linear rack (231) configured to engage with the buckle. Each of a plurality of perspective views, front and rear views, a right-side view, and top view are shown, respectively.

Figure 12:
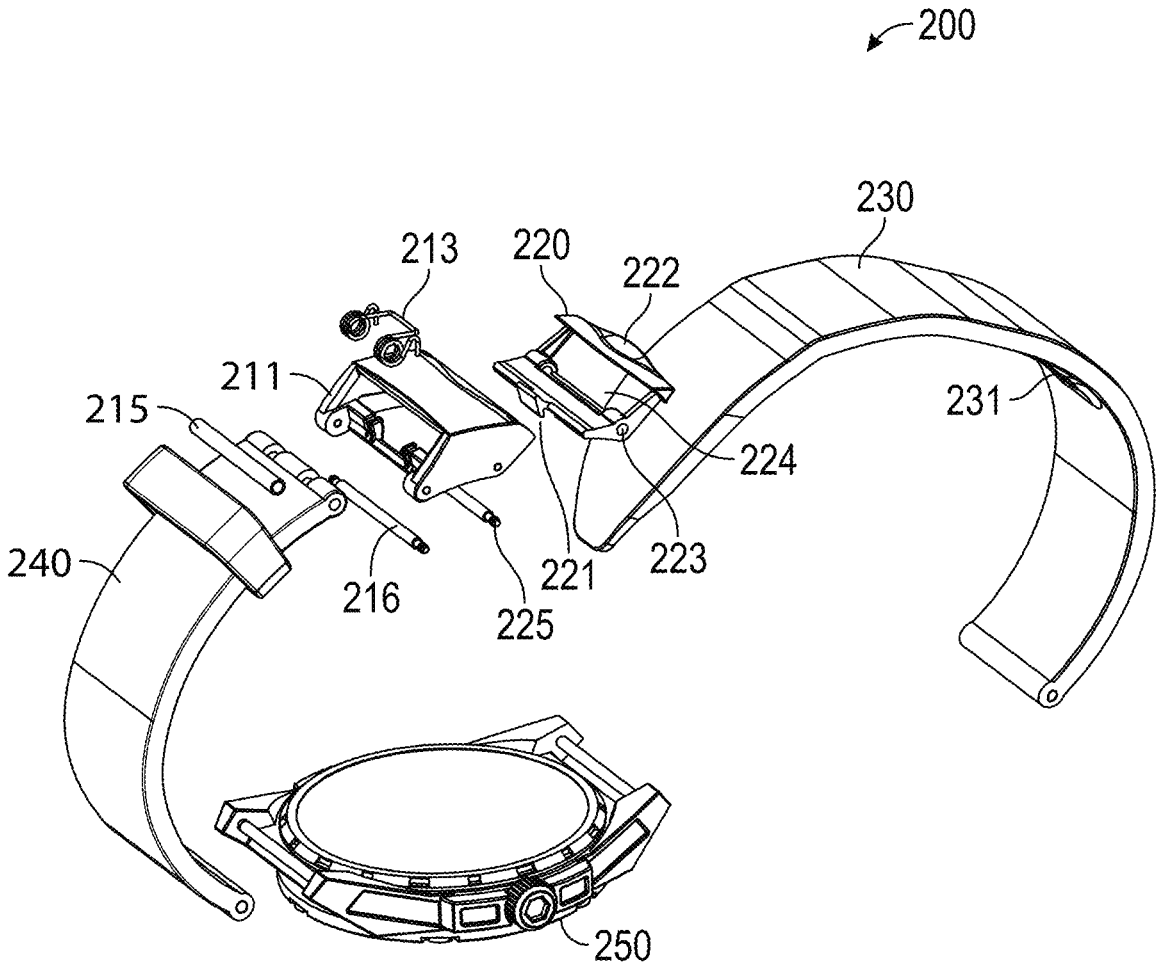
FIG. 12 shows an exploded view of the watch with ratcheting strap according to the second illustrated embodiment.

FIG. 12 shows an exploded view of the watch with ratcheting strap (200) according to the second illustrated embodiment. Various components are illustrated in relation to one another. Here, the watch in the second embodiment comprises a case assembly (250) configured for attachment with each of a first strap portion (230) and a second strap portion (240), preferably by conventional watch pins. The first strap portion comprises a linear rack (231), wherein the linear rack further comprises a plurality of teeth (See FIGS. 13(A-B)). The second strap portion is coupled to a buckle comprising each of a base (211), a linkage element (220), and a spring (213). The buckle is preferably coupled to the second strap portion using conventional watch pins. A spacer (215) is configured to be inserted through holes in the second strap portion, coupling the spring to the second strap portion at slots thereof. A watch pin (216) is configured to be inserted through an axis of the spacer and to engage the base of the buckle. The linkage element is configured to receive a first pin (225) at a fulcrum (223) through an axis of the linkage element, the first pin being further configured to engage a portion of the base, such that the linkage element is coupled to the base of the buckle at the first pin and the linkage element is configured to rotate about the fulcrum. The linkage element comprises a pawl (221) at a first terminal end. The linkage element further comprises a lever (222), the lever being disposed at a second terminal end opposite the first terminal end, wherein the fulcrum is disposed between the pawl and the lever of the linkage element. The spring is configured to engage each of the base and the linkage element, and to provide a bias force such that the pawl is defaulted in a locked position unless and until the lever is actuated, wherein upon translation of the lever—the pawl is disengaged from the linear rack and configured in an unlocked position.

Figure 13A:
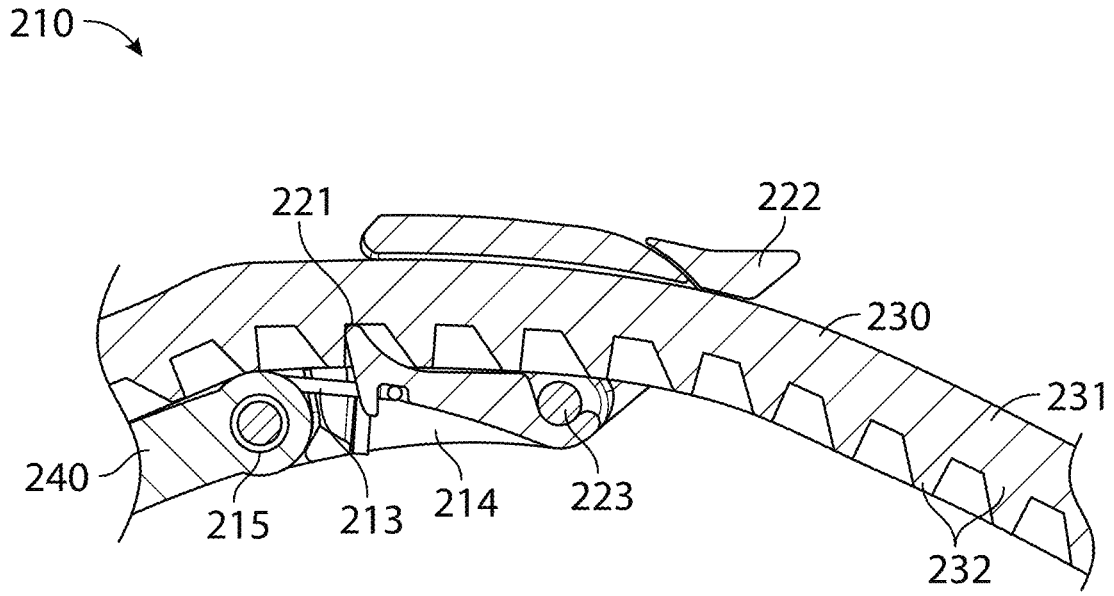
FIG. 13A shows a section of the watch strap and buckle in accordance with the second illustrated embodiment, the buckle being in a locked configuration.

FIG. 13A shows a section of the watch strap and buckle (210) in accordance with the second illustrated embodiment, the buckle being in a locked configuration, that is, with a pawl in the locked position due to a spring bias force (214). In this configuration, teeth (232) of the linear rack (231) will engage the pawl and a first strap portion (230) may not be removed from the buckle.

Figure 13B:
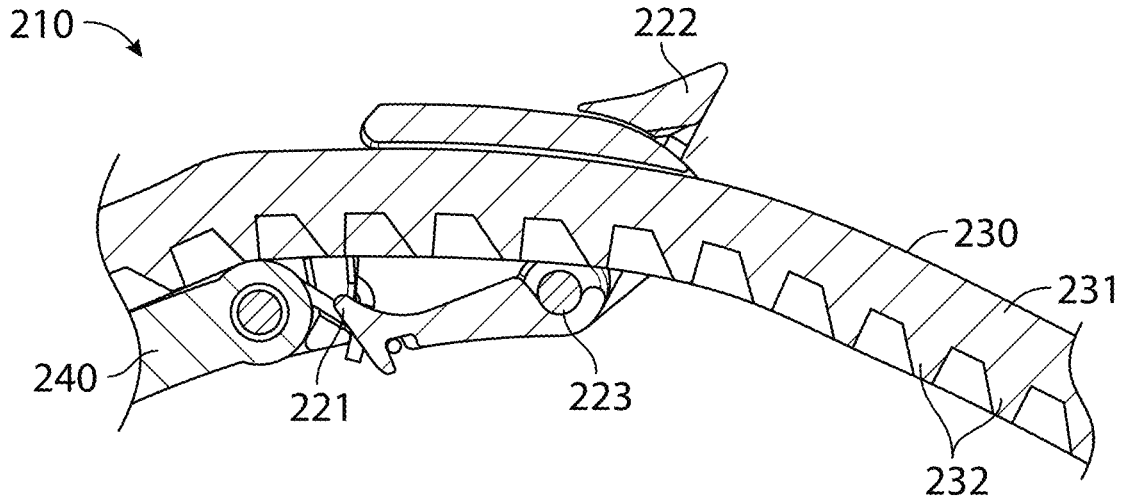
FIG. 13B shows a section of the watch strap and buckle in accordance with the second illustrated embodiment, the buckle being in an unlocked configuration.

FIG. 13B shows a section of the watch strap and buckle (210) in accordance with the second embodiment, the buckle being in an unlocked configuration, that is, with a pawl (221) in the unlocked position due to spring bias force (214). In this configuration, teeth (232) of the linear rack (231) will not engage the pawl and a first strap portion (230) may be removed from the buckle, that is, with a lever (222) actuated against the spring bias force.

Figure 14A:
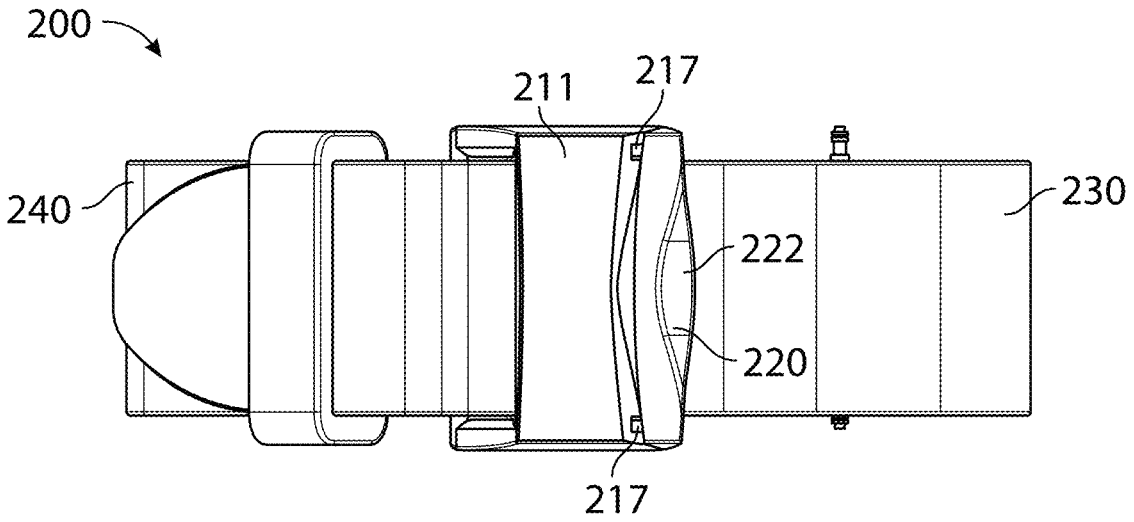
FIGS. 14(A-B) further show the watch strap and buckle in accordance with the second illustrated embodiment.
Figure 14B:
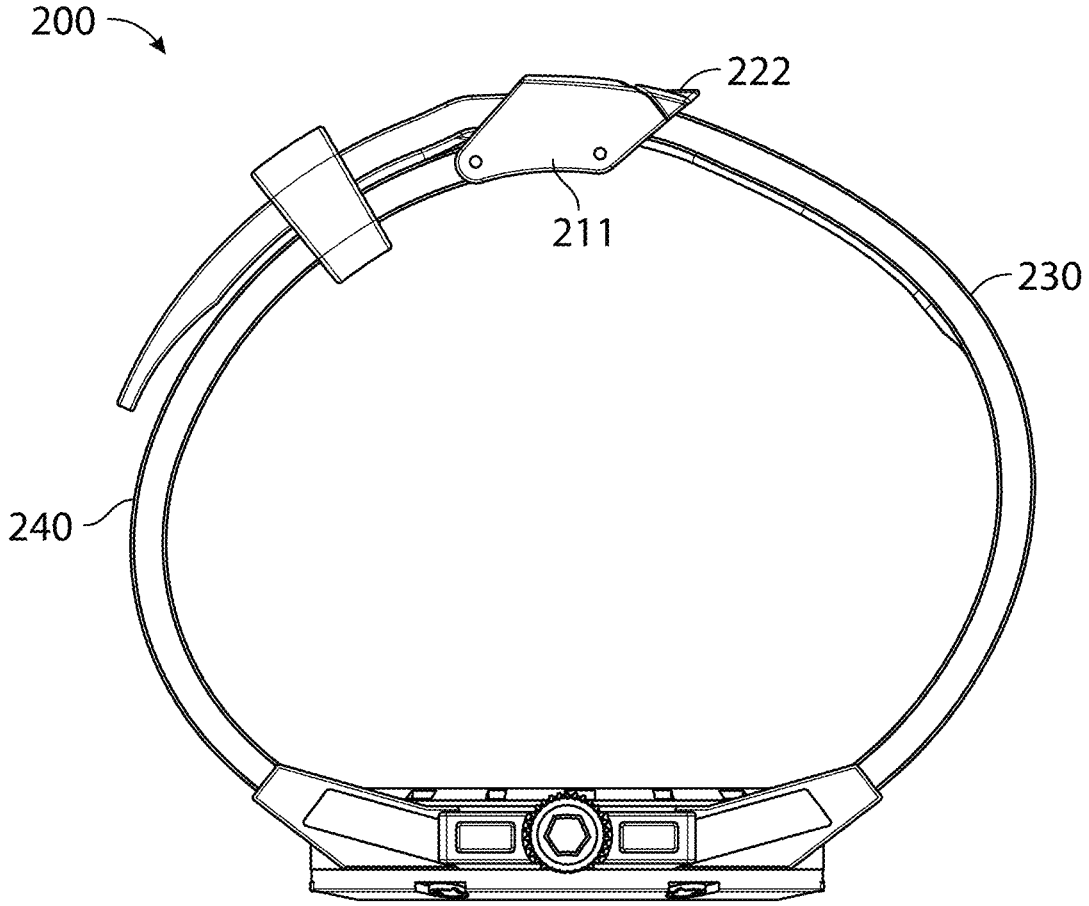

FIGS. 14(A-B) further show the watch strap and buckle (200) in accordance with the second illustrated embodiment. Here, a base (211) of the buckle comprises a pair of channels (217), wherein a portion of a linkage element (220) adjacent to a lever (222) is configured to nest within each of the pair of channels.

FEATURE LIST watch with ratcheting strap (100)
buckle (110)
base (111)
cam-lever (112)
spring (113)
cam portion (115)
lever portion (116)
second pin (117)
buckle aperture (118)
spacer (119)
linkage element (120)
pawl (121)
loading-brace (122)
fulcrum (123)
first pin (124)
linkage element aperture (125)
side portion (126)
first strap portion (130)
first strap pin (131)
linear rack (132)
plurality of teeth (133)
fabricated monolith piece (134)
first layer (135)
second layer (136)
stitch-line (137)
passing surface (138)
engaging surface (139)
second strap portion (140)
second strap pin (141)
case assembly (150)
first direction (160)
second direction (161)
watch with ratcheting strap (200)
buckle (210)
base (211)
spring (213)
spring bias (214)
spacer (215)
watch pin (216)
channel (217)
linkage element (220)
pawl (221)
lever (222)
fulcrum (223)
linkage element aperture (224)
first pin (225)
first strap portion (230)
linear rack (231)
plurality of teeth (232)
second strap portion (240)
case assembly (250)

What is claimed is:

1. A watchstrap for coupling to a watch, comprising:

a strap including a first strap portion and a second strap portion, the first strap portion comprising a linear rack and a plurality of teeth embedded in the linear rack, the first strap portion further comprising a first terminal end configured to couple to said watch, and the second strap portion coupled to a buckle, the second strap portion further comprising a second terminal end configured to couple to said watch;

the buckle further comprising a base and a linkage element the base being coupled to the linkage element via a first pin, the linkage element comprising a pawl, a lever, a linkage element aperture, and a fulcrum, wherein the fulcrum is disposed between the pawl and the lever, the linkage element aperture configured to receive the first strap portion engagement of the pawl with the linear rack, the first strap portion is disposed between the lever and the pawl;

wherein the pawl is configured to slideably engage with one or more of the plurality of teeth as the first strap portion is inserted through a buckle aperture and translated therethrough.

2. The watchstrap of claim 1, wherein upon translation of the lever, the linkage element is configured to rotate about the fulcrum, and the pawl is released from engagement with the plurality of teeth of the linear rack such that the first strap portion becomes releasable from the buckle.

3. The watchstrap of claim 1, wherein the first pin is disposed at the fulcrum.

4. The watchstrap of claim 1, wherein the pawl is configured to disengage from the linear rack upon the lever extending away from the first strap portion.

5. The watchstrap of claim 1, wherein the linear rack is disposed between the lever and the pawl during engagement of the pawl to the linear rack.

6. The watchstrap of claim 1, wherein the linear rack comprises a single linear rack disposed along a center region of the first strap portion.

7. The watchstrap of claim 1, the first strap portion further comprising an inner strap surface and an outer strap surface opposite the inner strap surface, wherein the inner strap surface is configured to contact a user's wrist, wherein the linear rack is disposed on the inner strap surface.

* * * * *